US005115578A

United States Patent [19]

Basten

[11] Patent Number: 5,115,578

[45] Date of Patent: May 26, 1992

[54] DISCHARGE MECHANISM FOR A LARGE FLUID BED/DRYER GRANULATOR

[75] Inventor: Aaron K. Basten, Solon, Iowa

[73] Assignee: Vector Corporation, Marion, Iowa

[21] Appl. No.: 664,792

[22] Filed: Mar. 5, 1991

[51] Int. Cl.[5] ..... F26B 17/00

[52] U.S. Cl. ..... 34/57 A; 34/239; 34/10; 432/58

[58] Field of Search ..... 34/57 A, 57 B, 57 R, 34/10, 239; 110/245; 432/58; 122/4 D; 422/143; 165/104.16; 431/7, 170

[56] References Cited

U.S. PATENT DOCUMENTS 3,253,944 5/1966 Wurster ..... 34/57 A
3,306,236 2/1967 Campbell ..... 34/57 A
3,441,258 4/1969 Gieskieng ..... 34/57 A
3,733,713 5/1973 Williamson, Jr. ..... 34/57 A
4,953,308 9/1990 Basten et al. ..... 34/82

*Primary Examiner*—Henry A. Bennet
*Assistant Examiner*—Denise L. F. Gromada
*Attorney, Agent, or Firm*—Hill, Van Santen, Steadman & Simpson

[57] ABSTRACT

A fluid bed dryer granulator which can be unloaded by moving the support screen downwardly relative to the product chamber so that the product can be moved radially out of the device. Portions of the machine can be pivoted so as to allow rapid and thorough cleaning of the device.

12 Claims, 3 Drawing Sheets

FIG. 3
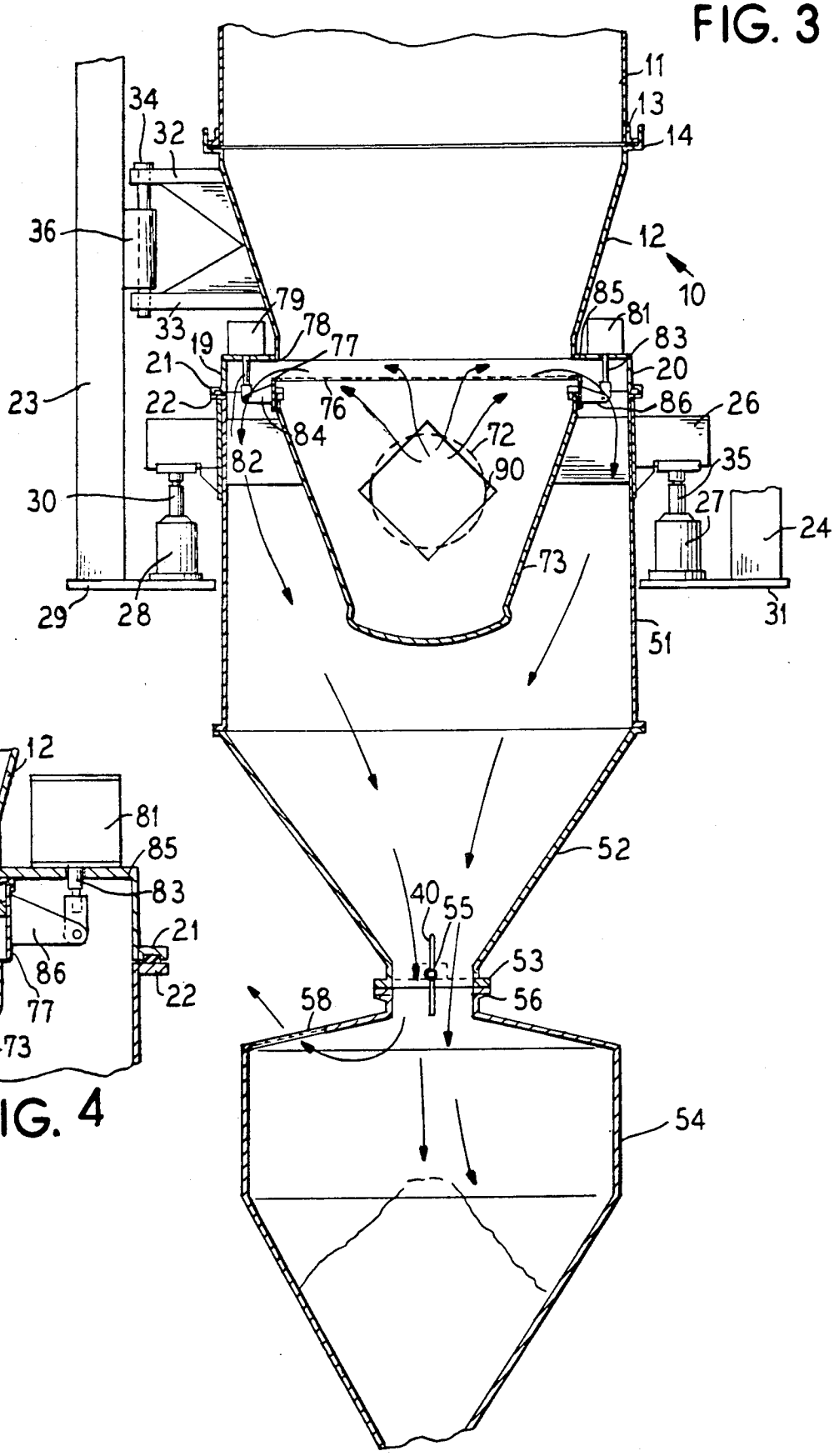
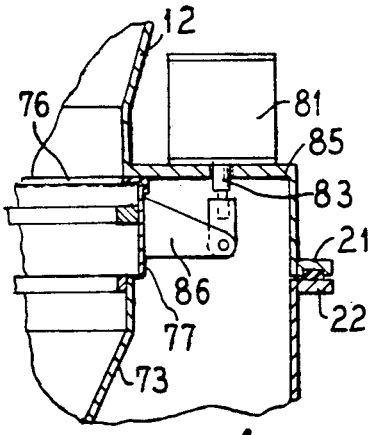
FIG. 4

FIG. 5
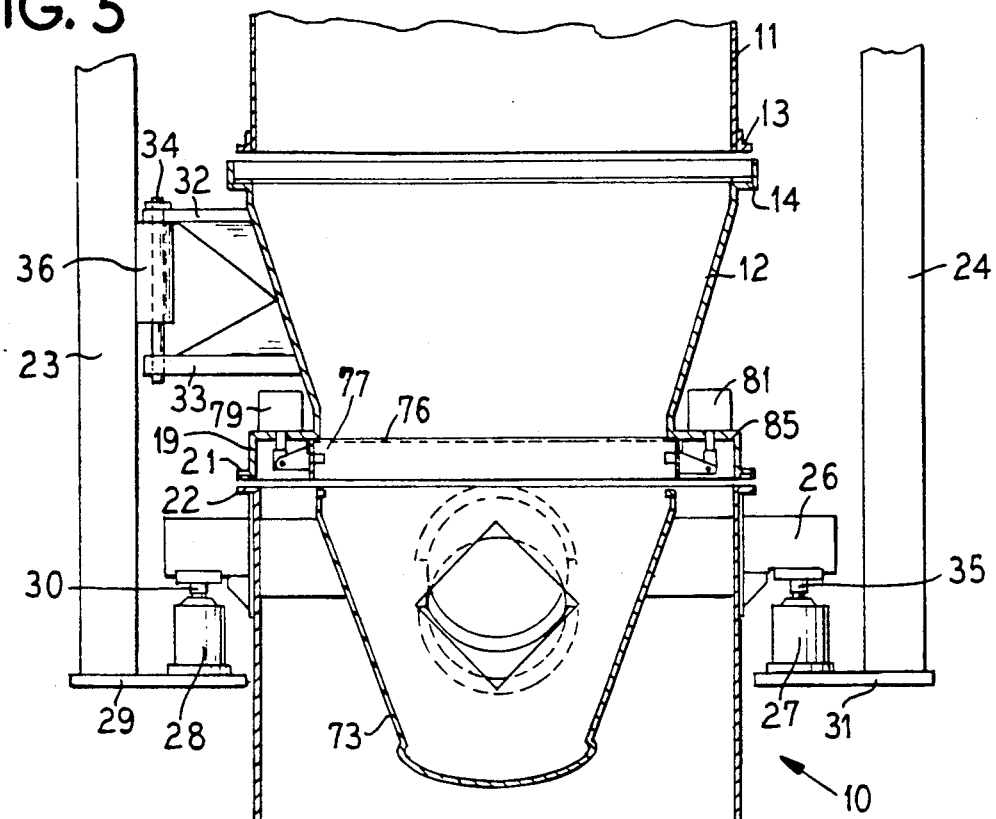
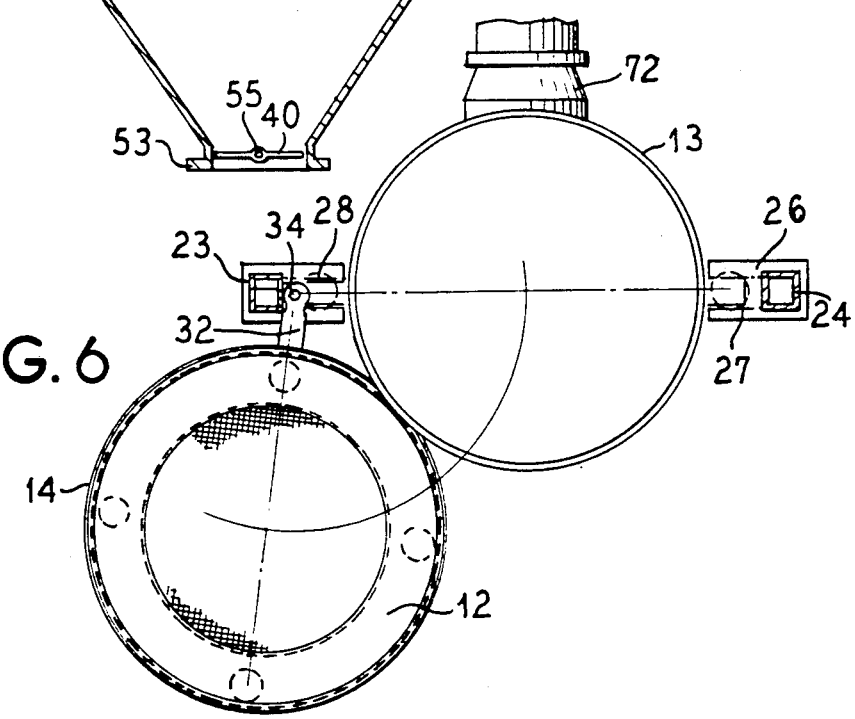
FIG. 6

DISCHARGE MECHANISM FOR A LARGE FLUID BED/DRYER GRANULATOR

BACKGROUND OF THE INVENTION

1. Field of the Invention

This invention relates in general to a discharge mechanism for a fluid bed/dryer granulator and to a cleanout mechanism.

2. Description of the Related Art

Fluid bed granulators are known as, for example, as disclosed in U.S. Pat. No. 4,953,308 entitled "Filter System For a Fluid Bed Granulator System" which issued on Sept. 4, 1990 assigned to the assignee of the present invention. A machine for drying, mixing, agglomerating or coating of powders or granules. The material sprayed into the fluidized bed can be either a binding material or a coating material.

SUMMARY OF THE INVENTION

The present invention comprises a fluid bed/dryer granulator which operates as a standard fluid bed unit when the inlet air plenum is in the up position and when the inlet air plenum is lowered the product can fall through the periphery opening into a discharge funnel. The inlet blower air assists by fluidizing the material and blowing it through the peripheral opening and out a discharge valve.

The present invention has the advantages in that 1) it eliminates rubber seals around the product screen, 2) it eliminates moveable inlet air duct and associated flexible seals, 3) it provides a dynamic product unloading for cleaner operation which is not entirely dependent on gravity, 4) it avoids blowing discharge products vacuumed to the lower surface of screen during the next process cycle, thus, minimizing screen blinding, 5) it eliminates product discharge into inlet air duct or a need for a special valve to prevent this; and 6) eliminates high torque rotary actuators.

The invention also provides a simple means of cleaning the machine by pivoting a segment of the processing chamber away from the machine after it has been unsealed so as to allow efficient and thorough cleaning of the machine.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 3 is a sectional view illustrating the invention in the unload position;

FIG. 4 is an enlarged cut-away view illustrating the sealing mechanism;

FIG. 5 is a partial sectional view illustrating the invention; and

FIG. 6 is a top plan view illustrating the machine opened for a cleaning.

DETAILED DESCRIPTION OF THE PREFERRED EMBODIMENTS

Figure 1:
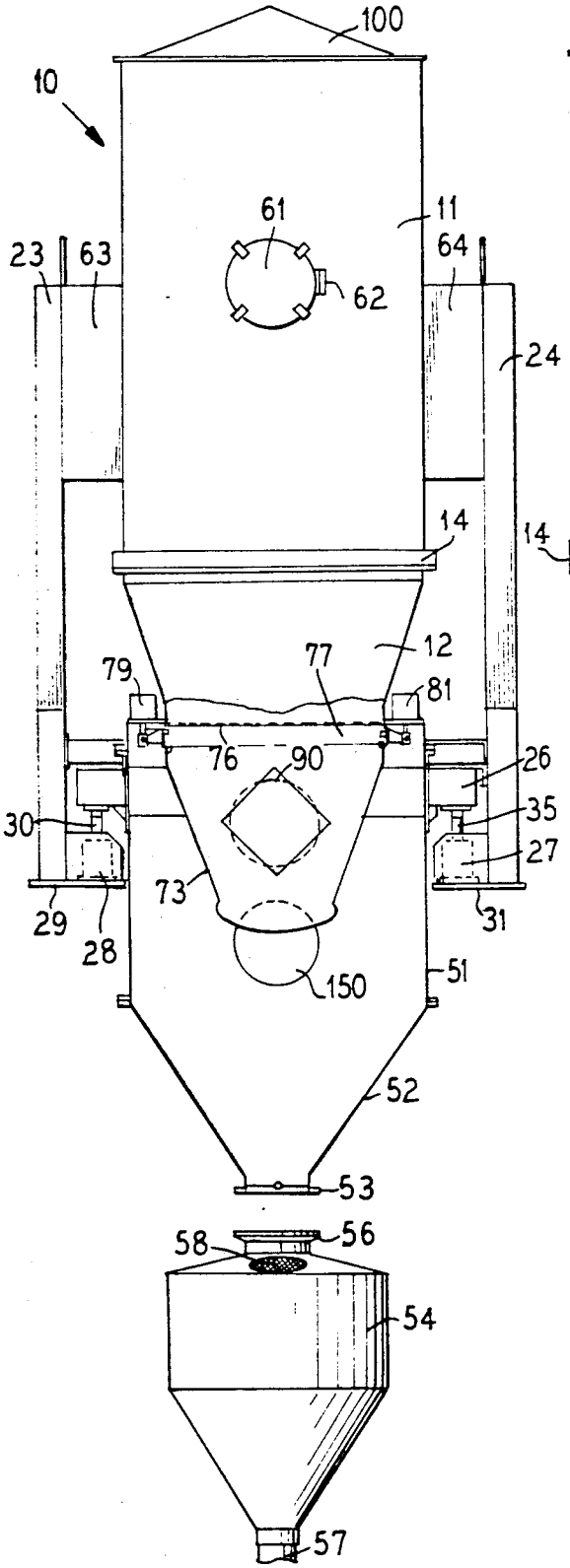
FIG. 1 is a plan view of the invention.
Figure 2:
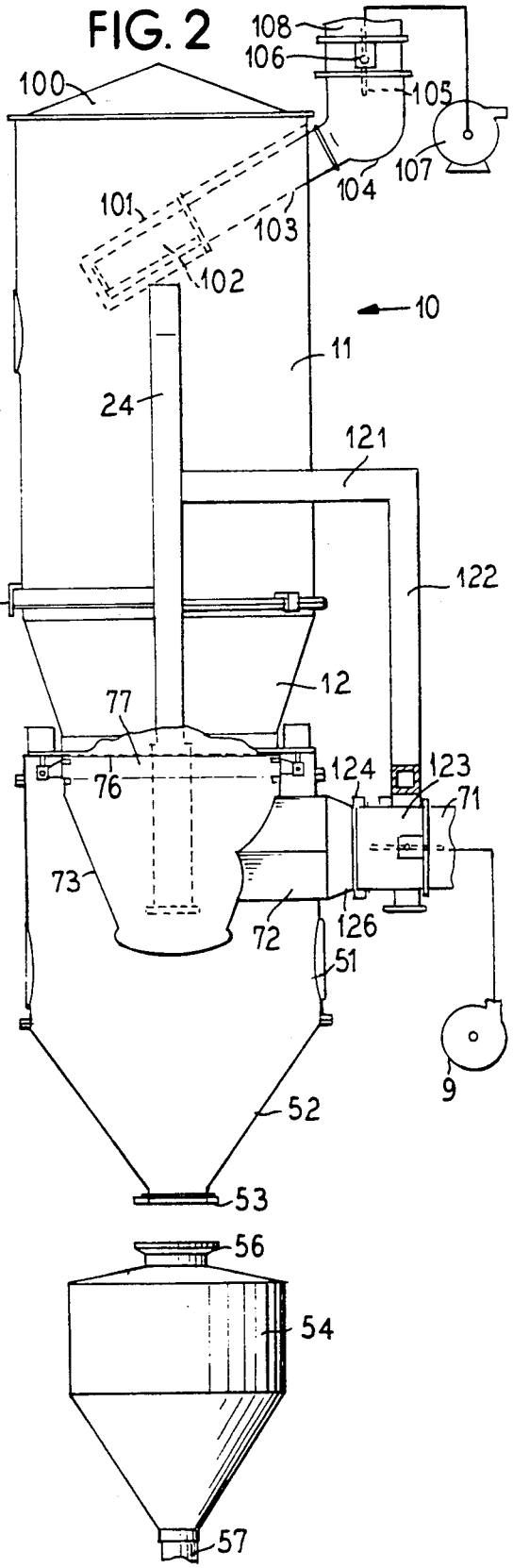
FIG. 2 is a plan view of the invention.

The FIGS. illustrate a fluid bed dryer granulator of the invention 10 which has a large upper cylindrical-shape chamber 11 which is attached to a lower truncated cone-shape portion 12 by means of a seal 13 and 14 between the member 11 and 12 as illustrated in FIGS. 3 and 5, for example. Main support members 23 and 24 are connected to the cylindrical member 11 by transverse members 63 and 64. An outlet 101 is formed in the upper portion of the cylindrical member 11, below the top cover 100 and a suitable filter 102 is mounted in the outlet 101 and a conduit 103 is connected to an outlet plenum 104 which has an outlet 108. A valve mechanism 106 can be controlled to open and close the outlet 108. A blower 107 is connected to plenum 104 to provide suction to move the air outwardly.

A conical-shaped member 73 is mounted below conical-shaped member 12 and a fluidizing screen 76 is mounted on a ring member 77 which is located between the top of the member 73 and the bottom of member 12. There is metal to metal contact between ring member (screen frame) 77 and the bottom of member 12. Member 73 and member 51 are moveable relative to the member 12 by cylinders 27 and 28 which have piston rods 30 and 35 that engage cross beam 26 that is connected to member 51 and member 73. Cylinders 79 and 81 have rods 82 and 83 and are mounted on the shoulder 85 and are attached to extensions 84 and 86 connected to screen frame 77. By actuating the cylinders 79 and 81, the member 77 can be sealed and unsealed relative to the member 12. FIG. 4 illustrates the member 73 sealed relative to the members 12 and 77 with the member 73 in the up position relative to the FIG. FIG. 3 illustrates the members 73 and 77 in the down position relative to the member 12 for the discharge mode or unsealed position which is utilized during unloading of the machine. The member 77 can move relative to the top of member 73 as the cylinders 79 and 81 are actuated.

Surrounding and below the member 73 is a cylindrical-shape member 51 which has a funnel-shaped portion 52 with an outlet seal member 53 in which is mounted a pivoted gate 40 mounted on a pivot shaft 55. A transverse beam 26 is attached to members 51 and 73 and rests on the upper end of piston rods 30 and 35 of hydraulic cylinders 28 and 27 which are mounted on bases 29 and 31 as shown in FIGS. 3 and 5. A seal is maintained between lower portion 19 of member 12 which extend downwardly from flange 85 and the lower end seal member 21 which mates with a seal member 22 attached to the member 51. When the cylinders 27 and 28 move the pistons rods 30 and 35 to the up position, they move the beam 26 upwardly to move the members 51 and 73 to the up position so that a seal exists between members 13 and 14 between members 11 and 12 and also a seal exists between members 21 and 22 of members 51 and 12. When piston rods 30 and 35 are moved to the down position as illustrated in FIG. 5, a seal between the members 11 and 12 is broken because the member 14 moves out of engagement with the member 13 and the member 22 moves out of engagement with the member 21. The member 12 can move vertically relative to the member 11 because it is supported by a hinge mechanism comprising support members 32 and 33 which are connected to a hinge pin 34 which moves through a hinge 36. A hinge pin 34 is longer than the hinge 36 as shown in FIGS. 3 and 5 so that when the piston rods 30 and 35 are moved into the up position, the member 51 can through the seal 21 and 55 move the member 12 to the sealed condition with the members 13 and 14 to engage as shown in FIG. 3.

A cleanout door 61 is supported by hinges 62 in the upper member 11. A support beam 121 is connected to beam 24 has a lower portion 122 which is connected to the inlet air duct 123 which is connected by seal 124, 126 to the duct 72. Air is drawn through the inlet 71 and member 123 to the inlet duct 72 into the member 12 through the opening 90 as shown in FIG. 1, for example.

In operation, air is drawn from outlet 108 through duct 103, filter 102 and inlet 101 up through the member 11 and through the products such as powders or granules which are supported on the screen 76 as liquid is sprayed by spraying mechanism, not shown. The air enters the member 73 through the opening 90 and inlet duct 72 through members 123 and inlet 71. During this condition, the members 11 and 12 are sealed by the seal 13 and 14. Also member 77 is sealed to member 12 by metal to metal contact. The member 51 is sealed as shown in FIGS. 4 and 5. Note that member 73 is not sealed to member 77 at this time. The butterfly valve 40 between member 52 and 54 is closed to provide an airtight seal at this time and the blower 107 draws the air through the machine at this time.

To unload the product, the cylinders 79 and 81 are actuated to move the member 77 to the position shown in FIG. 3 so that the seal between the member 77 and 12 is opened. It is to be noted that member 77 makes a slide fit with member 73 as shown in FIG. 4 so that they can move relative to each other. Member 77 is sealed to member 73 with a metal to metal seal when in the position shown in FIG. 3. The outlet duct 108 is closed by valve 105. The container 54 is sealed by the seal 53 and 56 to the member 52 and the butterfly valve 40 is opened. Then air is supplied by blower 9 through inlet 71 and opening 90 through the screen 76 to move the product in the chamber 12 radially outwardly through the opening between the members 77 and 12 so that the product follows the path of the arrows shown in FIG. 3 and into the container 54. Vents 58 allow the air to pass out of the top of the container 54.

For cleanup operation the unit may be opened and manually cleaned.

For opening the unit, all blowers are turned off, seals 124 and 126 are unsealed to allow members 73 and 123 to move vertically relative to each other. The product screen 76 and member 77 remains in the up position. The discharge funnel 51 is lowering by retracting the piston rods 30 and 35 by the cylinders 28 and 27. The product container 12 will lower part way due to the vertical moveable hinge 32, 33, 35 and 36 so that a gap is created between seal members 13 and 14 and also between the product container 12 and the member 77 and member 51 because the seals 21 and 22 are opened. The product container 12 and member 77 with the product screen 76 may be manually swung out clear of the main unit on the hinge pin 34 for access so as to allow the members 11, 73 and 51 as well as the air inlet plenum 72 to be cleaned through the spaces where the product container 12 was located before it was swung to the removed position shown in FIG. 6. Inspection doors 150 are also formed in member 51 to allow cleanup.

So as to remove the product screen, the product container 12 is swung out of position and the air cylinders 79 and 81 are extended so as to lower the screen 76 and its support 77.

It is seen that this invention provides a novel method and apparatus for unloading and cleaning fluid bed dryer granulator and although the invention has been described with respect to preferred embodiments, it is not to be so limited as changes and modifications can be made which are within the full intended scope of the invention as defined by the appended claims.

We claim as our invention:

1. A fluid bed dryer and granulator for product comprising, an upper container formed with an open bottom, a lower container formed with an open top and a screen extending over said open top, means for sealing and unsealing said upper and lower containers together with said screen between them, an air inlet in said lower container and an air outlet in said upper container, blower means for moving air from said air inlet through said lower container and through said screen and through said upper container and through said air outlet to process powders and granules in said upper container, when said upper and lower containers are sealed, and said air outlet is open and when said upper and lower containers are unsealed and said air outlet is closed said powders and granules are moved laterally between said screen and out of said upper container.

2. A fluid bed dryer and granulator according to claim 1 wherein said blower means comprises a first blower mounted in said air outlet and a second blower mounted in said air inlet, and a valve mounted in said air outlet which is open when said upper and lower containers are sealed.

3. A fluid bed dryer and granulator according to claim 1 wherein said means for sealing and unsealing said upper and lower containers comprises an actuator connected between said upper and lower containers.

4. A fluid fed and granulator according to claim 3 wherein said actuator comprises at least one fluid cylinder and piston connected to said upper and lower containers.

5. A fluid bed dryer and granulator according to claim 1 including a cleanout door formed in said dryer and granulator.

6. A fluid bed dryer and granulator according to claim 1 including an unloading container which substantially encloses said lower container and has an upper seal portion, a lower seal portion attached to said upper container and sealable with said upper seal portion of said unloading container.

7. A fluid bed dryer and granulator according to claim 6 including a closable gate in the bottom of said unloading container to allow product to be unloaded.

8. A fluid bed dryer and granulator according to claim 6 including a frame member, said upper container supported by said frame member, a cross beam attached to said lower container and said unloading container and adjustment means mounted between said frame member and said cross beam.

9. A fluid bed dryer and granulator according to claim 8 including screen supporting member slidably connected to said lower container and moveably connected to said upper container and said actuator connected to said screen supporting member to move it relative to said upper and lower containers.

10. A fluid bed dryer and granulator according to claim 9 wherein said upper container has upper and lower portions which can be joined together with the upper portion connected to said frame member, a hinge connected between said lower portion of said upper container and said frame member to allow movement of said lower portion about a vertical axis and said hinge adapted to allow said lower portion of said upper container to move vertically relative to said frame member when said adjustment means positions said lower container and said unloading container are in the down position.

11. A fluid bed dryer and granulator according to claim 10 wherein said adjustment means comprises at least one fluid cylinder and piston.

12. A fluid bed dryer and granulator according to claim 11 wherein when said adjustment means is in the up position said upper and lower portions of said upper container are sealed together and said unloading container is sealed to said upper container.

* * * * *

UNITED STATES PATENT AND TRADEMARK OFFICE

CERTIFICATE OF CORRECTION

PATENT NO. : 5,115,578

DATED : May 26, 1992

INVENTOR(S) : AARON K. BASTEN

It is certified that error appears in the above-identified patent and that said Letters Patent is hereby corrected as shown below:

Column 2, line 66, "seal 21 and 55", change to read --seals 21 and 22--.

Column 3, line 50, change "hinge 32, 33, 35 and 36" to read --hinges 32, 33, 34 and 36--.

Signed and Sealed this

Twelfth Day of September, 1995

*Attest:*

*Attesting Officer*

BRUCE LEHMAN

*Commissioner of Patents and Trademarks*